US005183354A

United States Patent [19]

Wright et al.

[11] Patent Number: 5,183,354

[45] Date of Patent: Feb. 2, 1993

[54] PROCESS FOR IN SITU RECYCLING OF ELECTRICAL POWER DISTRIBUTION SWITCHYARD AGGREGATE SURFACING

[75] Inventors: Roger G. Wright, Pasco; Leon J. Lindbloom, Richland; Lewis C. Midlam, Kennewick, all of Wash.

[73] Assignee: SCM Consultants, Inc., Kennewick, Wash.

[21] Appl. No.: 725,437

[22] Filed: Jul. 3, 1991

[51] Int. Cl.[5] ..... E01C 19/00; E01C 3/00

[52] U.S. Cl. ..... 404/81; 404/28; 209/44

[58] Field of Search ..... 423/244, 22; 366/1, 366/8, 17; 361/502; 404/18, 28, 81, 82, 91; 209/12, 44

[56] References Cited

U.S. PATENT DOCUMENTS

| | | | |
|---|---|---|---|
| 63,981 | 4/1867 | Aughinbaugh . | |
| 272,703 | 2/1883 | Jones | 209/235 |
| 1,918,348 | 7/1933 | Neddermeyer | 171/132 |
| 2,132,163 | 10/1938 | Henry | 209/244 |
| 3,405,613 | 10/1968 | Gustafson | 404/108 |
| 3,979,205 | 9/1976 | Wanzenberg | 423/22 X |
| 3,981,365 | 9/1976 | Arnold et al. | 171/63 |
| 4,226,542 | 10/1980 | Black et al. | 366/17 |
| 4,296,080 | 10/1981 | Rosensweig | 423/244 |
| 4,458,763 | 7/1984 | Rao et al. | 172/32 |
| 4,731,705 | 3/1988 | Valasco et al. | 361/502 |
| 4,927,293 | 5/1990 | Campbell | 405/128 |
| 4,998,625 | 3/1991 | Read | 209/238 |
| 5,000,615 | 3/1991 | Murray | 404/75 |

*Primary Examiner*—Carl D. Friedman
*Assistant Examiner*—Nancy P. Connolly
*Attorney, Agent, or Firm*—Wells, St. John, Roberts, Gregory & Matkin

[57] ABSTRACT

The present invention relates to a process for in situ recycling of aggregate surfacing used in power substations. An unsuitable aggregate surfacing contains a mixture of coarse and fine aggregate which results in an undesirably low surface resistivity. The first step of the process is to remove the unsuitable surfacing to a depth of approximately four to eight inches, thereby exposing an area of subgrade. The fine aggregate is then separated from the coarse aggregate. Next, the fine aggregate is replaced on the exposed area of the subgrade and compressed. Finally, the coarse aggregate is replaced on the fine aggregate. The process efficiently recycles the aggregate surfacing while on site at the substation, thereby eliminating the high cost of purchasing and transporting new aggregate surfacing, and disposing of unsuitable aggregate surfacing.

25 Claims, 1 Drawing Sheet

PROCESS FOR IN SITU RECYCLING OF ELECTRICAL POWER DISTRIBUTION SWITCHYARD AGGREGATE SURFACING

TECHNICAL FIELD

The present invention relates to a process for recycling of aggregate surfacing used in electrical power distribution switchyards.

BACKGROUND OF THE INVENTION

Electrical power distribution switchyards (or power substations) facilitate the distribution of power from a generation source (such as a hydroelectric dam or a coal plant) to utility customers. For example, in a hydroelectric power distribution system, power generated by the dam is initially routed to a primary power substation located near the dam. The primary power substation then distributes the power via power lines to secondary power substations located in various counties. The secondary power substations then further distribute the power to local power substations located in particular cities or towns. Distribution continues until the power is distributed to each residence in the cities and towns.

Power substations contain high voltage and high amperage power distribution equipment. Due to the presence of high voltage and amperage loads, the power distribution equipment poses a significant threat to the lives of utility personnel. Therefore, certain precautions must be made in the design and construction of substations to diminish the threat to personnel. Toward this end, utility companies issue specifications for the construction of power substations which ensure maximum safety of utility personnel.

One set of specifications concerns the surfacing of power substations. Substation surfacing consists of crushed aggregate (typically basalt or granite mineralogy), which is laid around the power distribution equipment, sidewalks, and building structures in the substation. The aggregate surfacing serves two purposes. First, and most importantly, the aggregate serves as an electrical barrier which protects utility companies' personnel in the event of an electrical fault. Second, the aggregate provides a suitable support surface for vehicles and portable utility equipment.

According to standard utility specifications, the aggregate surfacing must have a minimum resistivity of 3000 ohm-meters, which is considered to be sufficient to protect personnel in the event of an electrical fault. The resistivity of the aggregate surfacing is directly related to the size and corresponding voids ratio of the individual nuggets which make up the aggregate. Larger grade nuggets have higher resistivity than smaller grade nuggets. Therefore, aggregate surfacing having the larger grade nuggets, referred to as "coarse aggregate", has a higher resistivity than aggregate surfacing having smaller grade nuggets (or finer materials such as sand, silt, clay, volcanic ash, or organic material), referred to as "fine aggregate".

The minimum resistivity requirement is easily satisfied when the aggregate surfacing is first laid because only coarse aggregate is employed. Unfortunately, over time, fine aggregate infiltrates the coarse aggregate, thereby lowering the resistivity of the surfacing. The fine aggregate infiltrates the coarse aggregate in many ways. For example, the fine aggregate may be blown by the wind and deposited on the coarse aggregate surfacing. Alternatively, the weight of the coarse aggregate and the weight of utility personnel and vehicles may force the coarse aggregate down into a subgrade which consists primarily of fine aggregate.

As the fine aggregate accumulates in the coarse aggregate, the resistivity of the substation surfacing decreases below the minimum resistivity level (e.g., 3000 ohm-meters), thereby rendering the surfacing unsuitable. Therefore, the mixed fine and coarse aggregate surfacing must be removed and replaced with a new coarse aggregate surfacing which satisfies the minimum resistivity requirements.

Two techniques have been employed to replace unsuitable substation surfaces. One technique is simply to add more coarse aggregate to the top of the existing, unsuitable surface. This technique has a disadvantage in that extra coarse aggregate may be added only a few times since the increasing elevation of the aggregate surfacing would eventually rise above sidewalks, power equipment bases, substation fences, and building foundations.

A second technique is to remove and dispose of the unsuitable surfacing, and then lay an entirely new aggregate surfacing which satisfies the utility companies' requirements. The second technique is expensive, however, due to the high costs of disposing of the unsuitable surfacing which may be contaminated with toxicogenics.

Another disadvantage of both techniques is that adding a new aggregate surfacing is very expensive because the sources of coarse aggregate are limited and the transportation costs associated with transporting the coarse aggregate from the source to the remote power substation are high.

The present invention relates to a process for in situ recycling of aggregate surfacing used in power substations. According to the process of the present invention, the unsuitable surfacing is removed, recycled and then relaid as a suitable aggregate surfacing. In this manner, the high cost of purchasing and transporting new aggregate surfacing is eliminated. Furthermore, the process is very efficient because the entire resurfacing may be performed on site at the power substation.

BRIEF DESCRIPTION OF THE DRAWINGS

Preferred embodiments of the invention are described below with reference to the accompanying drawings. Collectively.

FIG. 1 shows an old, unsuitable aggregate surfacing of an electrical power distribution switchyard prior to recycling;

FIG. 2 shows an exposed subgrade after the unsuitable aggregate surfacing has been removed;

FIG. 3 shows a layer of fine aggregate on top of the subgrade; and

FIG. 4 shows a recycled, suitable aggregate surfacing of an electrical power distribution switchyard.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Specifications for power substation surfacing vary slightly among the Public Utility Districts (PUDs), Electrical Cooperatives (ECs), and The Bonneville Power Administration (BPA). Most PUDs and ECs follow the BPA surfacing specifications, which provide, inter alia, gradation requirements for the surfacing aggregate. Gradation requirements establish what percentage by weight of the aggregate is allowed to pass through a sieve for each particular aperture size. Table 1 lists the BPA's gradation requirements.

TABLE 1

Aggregate Gradation Requirements of the BPA Surfacing Specifications

| U.S. Standard Sieve Size (in inches) | BPA Standard for Switchyard Surfacing Percent Passing Through the Sieve (by weight) |
|---|---|
| 1½ | 100 |
| ¾ | 0-25 |
| ⅝ | 0-25 |
| ½ | 0-5 |

Other general requirements contained in the surfacing specifications include:

(1) Minimum depth of three inches of surfacing which satisfies the gradation specification.

(2) Fractured faces minimum count of 100% one face fracture and 70% three face fracture.

(3) DMSO accelerated weathering loss of 12% maximum.

(4) Resistivity of at least 3000 ohm-meters.

The 1½, ¾ and ⅝ inch gradation requirements and the fractured faces count relate mainly to requirements associated with a driving surface for vehicles. The depth requirement ensures an adequate protective barrier for the personnel, and the weathering requirement ensures that the aggregate will not rapidly break down.

Resistivity is defined as electrical resistance per unit length of a unit cross-sectional area. For purposes of substation surfacing, resistivity is measured in ohm-meters.

The resistivity of a substation surface varies considerably depending upon the material and gradation employed in the aggregate. The present inventors have discovered that the resistivity of aggregate surfacing is approximately related to gradation. Specifically, the inventors have discovered that an aggregate surfacing having a resistivity greater than 3000 ohm-meters may be obtained by employing aggregate of sufficient size that less than 5% by weight of the aggregate would pass through a sieve having ¼ inch apertures. In other words, the inventors have discovered that the ¼ inch sieve properly separates fine aggregate of low resistivity from coarse aggregate of high resistivity, such that the resistivity of the coarse aggregate is greater than 3000 ohm-meters.

The process for recycling aggregate surfacing used in a power substation will now be described with reference to FIGS. 1-4.

Figure 1:
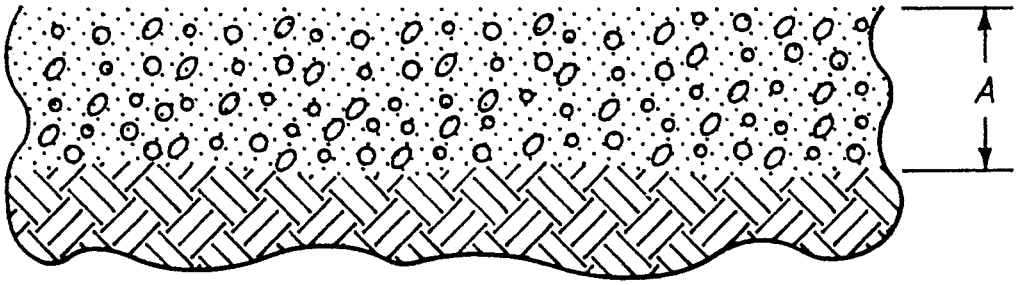
FIGS. 1–4 illustrate a process for recycling aggregate surfacing used in electrical power distribution switchyards according to the present invention. Specifically, each Figure depicts the following.

As shown in FIG. 1, an unsuitable aggregate surfacing 10, consisting of a mixture of coarse aggregate 12 and fine aggregate 14, lies above a subgrade 16. Due to the presence of the low resistive fine aggregate 14, the aggregate surfacing 10 has a resistivity which is below BPA's minimum resistivity requirement of 3000 ohm-meters. Therefore, the aggregate surfacing 10 is unsuitable and must be replaced.

The first step according to the present invention is to remove the aggregate surfacing 10 and stockpile the surfacing within the power substation. The aggregate surfacing 10 may be removed with a bulldozer, a front end loader, or the like. The aggregate surfacing 10 is removed to a depth A which is sufficient to recover substantially all of the coarse aggregate 12. The depth A is typically four to eight inches. Removing the aggregate surfacing 10 to a depth beyond eight inches is not preferred, nor recommended, because of a potential danger of disturbing buried ground grid cables, conduits, or the like.

Figure 2:
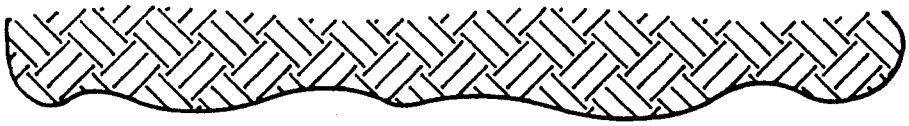

Removal of the aggregate surfacing 10 exposes an area of the subgrade 16 as shown in FIG. 2.

The next step is to separate the fine aggregate 14 from the coarse aggregate 12 using a sieve with the appropriate aperture size. As discussed above, a sieve having ¼ inch apertures effectively passes the fine aggregate 14 and prevents passage of the coarse aggregate 12. The passed fine aggregate 14 comprises less than 5% by weight of the aggregate surfacing 10. The coarse aggregate 12, which is not passed through the ¼ inch sieve, has a resistivity greater than 3000 ohm-meters.

Although a ¼ inch sieve is preferred, other sieve sizes are suitable. For example, a ⅝ inch or ¾ inch sieve which passes less than 25% by weight of the aggregate surfacing 10 will satisfy the BPA minimum resistivity requirements.

The sieve used to separate the fine aggregate 14 from the coarse aggregate 12 may be placed on an exposed area of the subgrade and grounded to the buried ground grid via a 2/0 copper cable, or the like. In this manner, the fine aggregate 14 passed through the sieve may accumulate in a pile on the exposed area to facilitate easy distribution over the entire exposed area. The coarse aggregate 12 is removed from the sieve and stockpiled at the substation for later distribution, as will be described below in more detail.

Figure 3:
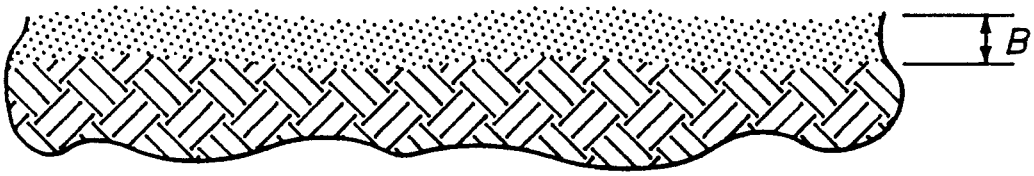

After being passed through the sieve, the fine aggregate 14 is spread over the exposed area of the subgrade to form a layer 18 of fine aggregate as shown in FIG. 3. The layer 18 of fine aggregate has a thickness B of approximately two inches or less. The thickness B is dependent upon the grain size and moisture content of the fine aggregate 14. Water may be added immediately after the separation step to increase the moisture content and reduce any potential dust problems.

The layer 18 of the fine aggregate 14 may then be compressed by a heavy rubber roller. The layer 18 is preferably compressed to a density equal to the density of the subgrade 16. A rubber roller is employed to avoid damaging underground cables or conduits.

Figure 4:
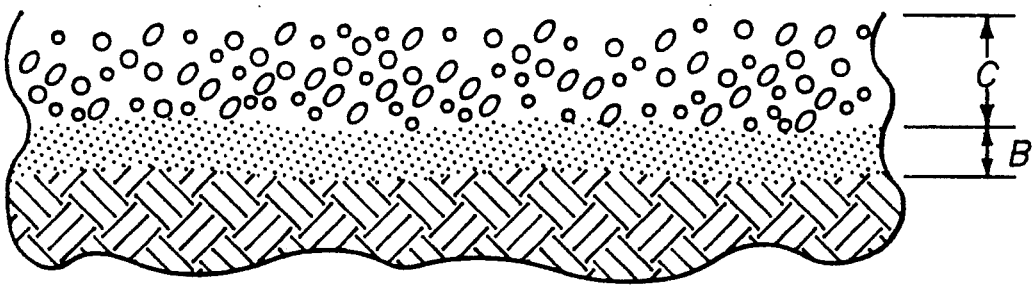

The final step according to the present invention is to distribute the coarse aggregate 12 on the layer 18 of the fine aggregate 14, as shown in FIG. 4. The coarse aggregate 12 forms a layer 20 having as thickness C which is not less than three inches. A thickness less than three inches fails to comply with the BPA's minimum depth requirement (discussed above). The layer 20 is level and has approximately constant thickness throughout the entire surfacing area.

The new aggregate surfacing, consisting of the coarse aggregate layer 20, satisfies the BPA specifications discussed above. Particularly, the aggregate surfacing has a resistivity greater than 3000 ohm-meters and a thickness greater than three inches.

The process for recycling aggregate surfacing used in power substations according to the present invention has three significant advantages over conventional techniques. First, the high cost of purchasing new aggregate and transporting the new aggregate to the remote substation location is avoided because the present invention permits in situ recycling. According to the present process, a construction crew may remove, recycle, and then replace the aggregate surfacing without leaving the substation premises. No new aggregate (and thus no transportation of new aggregate) is required. Second, the cost and difficulty of disposing of old, contaminated surfacing is avoided because the old aggregate surfacing is recycled and used. Third, the problems associated with adding more and more new aggregate are eliminated.

In compliance with the statute, the invention has been described in language more or less specific as to methodical features. The invention is not, however, limited to the specific features described, since the methods herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A process for recycling aggregate surfacing of an electrical power distribution switchyard, comprising the steps of:

removing a surface having a mixture of course aggregate and fine aggregate to expose an area;

separating the fine aggregate from the coarse aggregate;

replacing the fine aggregate on the exposed area to form a layer of fine aggregate; and replacing the coarse aggregate on the layer of fine aggregate.

2. The process for recycling aggregate surfacing as defined in claim 1, wherein the step of removing comprises the step of removing the surface to a predetermined depth sufficient to recover a substantial percentage of the coarse aggregate.

3. The process for recycling aggregate surfacing as defined in claim 2, wherein the predetermined depth is approximately four to eight inches.

4. The process for recycling aggregate surfacing as defined in claim 1, wherein the step of separating comprises the step of passing the fine aggregate through a sieve device, whereby the sieve device prevents passage of the coarse aggregate.

5. The process for recycling aggregate surfacing as defined in claim 4, wherein the fine aggregate is passed through a sieve device having apertures between $\frac{1}{4}$ inches and $\frac{3}{4}$ inches.

6. The process for recycling aggregate surfacing as defined in claim 4, wherein the fine aggregate is passed through a sieve device having apertures of approximately $\frac{1}{4}$ inches.

7. The process for recycling aggregate surfacing as defined in claim 1, further comprising the step of compressing the layer of fine aggregate before the step of replacing the coarse aggregate.

8. The process for recycling aggregate surfacing as defined in claim 7, wherein the step of compressing comprises the step of compressing the layer of fine aggregate using a heavy rubber roller.

9. The process for recycling aggregate surfacing as defined in claim 1, wherein the layer of fine aggregate has a thickness of approximately two inches or less.

10. The process for recycling aggregate surfacing as defined in claim 1, wherein the replaced coarse aggregate has a resistivity greater than 3000 ohm-meters.

11. The process for recycling aggregate surfacing as defined in claim 1, wherein the coarse aggregate forms a layer having a thickness not less than three inches.

12. The process for recycling aggregate surfacing as defined in claim 1, further comprising the step of adding moisture to the fine aggregate before the step of replacing the coarse aggregate.

13. A process for recycling aggregate surfacing of an electrical power distribution switchyard, comprising the steps of:

removing a surface having a mixture of course aggregate and fine aggregate to a predetermined depth, thereby exposing an area;

separating the fine aggregate from the coarse aggregate by passing less than 25% by weight of the removed surface through a sieve device having apertures of approximately $\frac{3}{4}$ inches or smaller, the passed portion of the removed surface constituting the fine aggregate and the non-passed portion constituting the coarse aggregate;

replacing the fine aggregate on the exposed area to form a layer of fine aggregate; and replacing the coarse aggregate on the layer of fine aggregate.

14. The process for recycling aggregate surfacing as defined in claim 13, wherein the predetermined depth is approximately four to eight inches.

15. The process for recycling aggregate surfacing as defined in claim 13, further comprising the step of compressing the layer of fine aggregate before the step of replacing the coarse aggregate.

16. The process for recycling aggregate surfacing as defined in claim 13, wherein the layer of fine aggregate has a thickness of approximately two inches or less.

17. The process for recycling aggregate surfacing as defined in claim 13, wherein the coarse aggregate forms a layer having a thickness not less than three inches.

18. A process for recycling aggregate surfacing of an electrical power distribution switchyard, comprising the steps of:

removing a surface having a mixture of course aggregate and fine aggregate to a predetermined depth, thereby exposing an area;

separating the fine aggregate from the coarse aggregate by passing less than 5% by weight of the removed surface through a sieve device having apertures of approximately $\frac{1}{4}$ inches, the passed portion of the removed surface constituting the fine aggregate and the non-passed portion constituting the coarse aggregate;

replacing the fine aggregate on the exposed area to form a layer of fine aggregate; and replacing the coarse aggregate on the layer of fine aggregate.

19. The process for recycling aggregate surfacing as defined in claim 18, wherein the predetermined depth of approximately four to eight inches.

20. The process for recycling aggregate surfacing as defined in claim 18, further comprising the step of compressing the layer of fine aggregate before the step of replacing the coarse aggregate.

21. The process for recycling aggregate surfacing as defined in claim 18, wherein the layer of fine aggregate has a thickness of approximately two inches or less.

22. The process for recycling aggregate surfacing as defined in claim 18, wherein the coarse aggregate forms a layer having a thickness not less than three inches.

23. A process for recycling aggregate surfacing of an electrical power distribution switchyard, comprising the steps of:

removing a surface having a mixture of course aggregate and fine aggregate to a depth of approximately four to eight inches, thereby exposing an area;

separating the fine aggregate from the coarse aggregate by passing a predetermined percentage by weight of the removed surface through a sieve device having apertures of a predetermined diameter, the passed portion of the removed surface constituting the fine aggregate and the non-passed portion constituting the coarse aggregate;

replacing the fine aggregate on the exposed area to form a layer of fine aggregate;

compressing the layer of fine aggregate; and replacing the coarse aggregate on the layer of fine aggregate.

24. The process for recycling aggregate surfacing as defined in claim 23, wherein the predetermined percentage is 25% and the predetermined diameter is approximately $\frac{3}{4}$ inches or smaller.

25. The process for recycling aggregate surfacing as defined in claim 23, wherein the predetermined percentage is 5% and the predetermined diameter is approximately $\frac{1}{4}$ inches.

* * * * *